US011310589B2

(12) United States Patent
Li et al.

(10) Patent No.: US 11,310,589 B2
(45) Date of Patent: Apr. 19, 2022

(54) AUDIOVISUAL DEVICE AND CONTROL METHOD OF AUDIOVISUAL DEVICE

(71) Applicant: BOE TECHNOLOGY GROUP CO., LTD., Beijing (CN)

(72) Inventors: Wenbo Li, Beijing (CN); Zhihong Du, Beijing (CN); Junwei Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 644 days.

(21) Appl. No.: 16/314,999

(22) PCT Filed: Feb. 28, 2018

(86) PCT No.: PCT/CN2018/077575

§ 371 (c)(1),
(2) Date: Jan. 3, 2019

(87) PCT Pub. No.: WO2019/015327

PCT Pub. Date: Jan. 24, 2019

(65) Prior Publication Data

US 2021/0329372 A1 Oct. 21, 2021

(30) Foreign Application Priority Data

Jul. 21, 2017 (CN) ..... 201710602760.3

(51) Int. Cl.
*H04R 1/32* (2006.01)
*H04R 3/00* (2006.01)

(52) U.S. Cl.
CPC ..... *H04R 1/323* (2013.01); *H04R 3/00* (2013.01); *H04R 2499/15* (2013.01)

(58) Field of Classification Search
CPC ..... H04R 1/323; H04R 3/00; H04R 2499/15
See application file for complete search history.

(56) References Cited

U.S. PATENT DOCUMENTS

2006/0147053 A1 7/2006 Kong
2008/0130983 A1 6/2008 Wan
(Continued)

FOREIGN PATENT DOCUMENTS

CN 1106184 A 8/1995
CN 1799903 A 7/2006
(Continued)

OTHER PUBLICATIONS

Interational Search Report and Written Opinion dated Jun. 4, 2018.
First Chinese Office Action dated Nov. 23, 2018.

*Primary Examiner* — Andrew L Sniezek
(74) *Attorney, Agent, or Firm* — Dilworth & Barrese, LLP.; Michael J. Musella, Esq.

(57) ABSTRACT

An audiovisual device and a control method of the audiovisual device are provided, the audiovisual device includes a backboard, the backboard is provided with a directional speaker, a regulator component and a display component that is configured for providing visual content, the directional speaker is configured for emitting a directional sound to a display side of the display component, and the regulator component is configured for regulating an orientation of the directional speaker on the display side of the display component.

12 Claims, 9 Drawing Sheets

(56) References Cited

U.S. PATENT DOCUMENTS

| | | | | |
|---|---|---|---|---|
| 2010/0020990 | A1* | 1/2010 | Moon | B06B 3/00 381/161 |
| 2014/0151516 | A1* | 6/2014 | Liu | H04R 1/026 248/124.1 |
| 2016/0021454 | A1* | 1/2016 | Liang | H04R 1/403 381/333 |

FOREIGN PATENT DOCUMENTS

| | | | |
|---|---|---|---|
| CN | 101098565 | A | 1/2008 |
| CN | 201813515 | U | 4/2011 |
| CN | 103167375 | A | 6/2013 |
| CN | 103233209 | A | 8/2013 |
| CN | 203259970 | U | 10/2013 |
| CN | 104469597 | A | 3/2015 |
| CN | 104486704 | A | 4/2015 |
| CN | 106412751 | A | 2/2017 |
| CN | 107396234 | A | 11/2017 |
| KR | 20070110950 | A | 11/2007 |

* cited by examiner

AUDIOVISUAL DEVICE AND CONTROL METHOD OF AUDIOVISUAL DEVICE

This application claims the benefit of Chinese patent application No. 201710602760.3 filed on Jul. 21, 2017, which is hereby entirely incorporated by reference as a part of the present application.

TECHNICAL FIELD

Embodiments of the present disclosure relate to an audiovisual device and a control method of the audiovisual device.

BACKGROUND

The audiovisual device is a device with an audio function and a visual function, such as a physical picture frame with the audio function and an electronic picture frame with the audio function.

SUMMARY

According to embodiments of the present disclosure, an audiovisual device includes a backboard. The backboard is provided with a directional speaker, a regulator component, and a display component for providing visual content, the directional speaker is configured for emitting a directional sound to a display side of the display component, and the regulator component is configured for regulating an orientation of the directional speaker on the display side of the display component.

For example, the directional speaker is configured for emitting the directional sound to a preset service area, the preset service area is on the display side of the display component, and the audiovisual device further includes a processor component and a sensor component; the sensor component is configured for determining whether a human body exists in the preset service area; the processor component is configured for activating the directional speaker in a situation where the human body exists in the preset service area.

For example, the sensor component is further configured for obtaining a direction in which the human body is located in the situation where the human body exists in the preset service area; the regulator component is configured for directing the directional speaker toward the direction in which the human body is located.

For example, the regulator component includes a motor and a rotation rod; the directional speaker is rotatably connected with the backboard through the rotation rod, and the rotation rod is provided with a first gear; a rotation shaft of the motor is provided with a second gear, and the second gear engages with the first gear.

For example, the regulator component includes a regulation knob and a rotation rod; the directional speaker is rotatably connected with the backboard through the rotation rod, and the regulation knob is connected with an end of the rotation rod.

For example, the regulator component further includes a dial that is connected with the backboard and is configured for indicating a rotation angle of the regulation knob.

For example, the display component includes a rectangular display screen; the directional speaker includes at least one strip sub-speaker, and a side of the sub-speaker and a side of the display screen are parallel to each other.

For example, the directional speaker includes an amplifier and a metal polymer film, and the amplifier is configured for amplifying an audio signal input by the processor component and then transmitting the audio signal to the metal polymer film, so that the metal polymer film vibrates to generate an ultrasonic wave.

According to the embodiments of the present disclosure, a control method of the audiovisual device is provided and is configured for controlling the audiovisual device as described above. The method includes: activating the display component; directing the directional speaker toward a target direction through the regulator component; and activating the directional speaker.

For example, the directional speaker is configured for emitting the directional sound to a preset service area, the preset service area is on the display side of the display component, and the audiovisual device further includes a processor component and a sensor component; before the directing the directional speaker toward the target direction through the regulator component, the method further includes: determining whether a human body exists in the preset service area through the sensor component.

For example, before the directing the directional speaker toward the target direction through the regulator component, the method further includes: in a situation where the human body exists in the preset service area, obtaining a direction in which the human body is located through the sensor component, and determining the direction in which the human body is located as the target direction.

For example, after the activating the directional speaker, the method further includes: determining, through the sensor component, whether the human body exists in the preset service area after a first preset time period that is after the activating the directional speaker; and turning off the directional speaker in a situation where no human body exists in the preset service area.

For example, after turning off the directional speaker, the method further includes: after a second preset time period that is after the turning off of the directional speaker, determining whether the human body exists in the preset service area through the sensor component; and in the situation where the human body exists in the preset service area, performing a step of determining whether the human body exists in the preset service area through the sensor component.

For example, the activating the directional speaker includes: activating the directional speaker so that the directional speaker emits the directional sound that is associated with the visual content.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

FIG. 3-1 is another schematic structural view of the audiovisual device according to the embodiments of the present disclosure;

FIG. 3-2 is a schematic view of the audiovisual device shown in FIG. 3-1 and a preset service area;

FIG. 3-3 is a schematic view of an acoustic system involving a directional speaker in the embodiments of the present disclosure and a human ear;

FIG. 3-4 is a schematic structural view of the directional speaker and a regulator component that are in the audiovisual device shown in FIG. 3-1;

FIG. 3-5 is another schematic structural view of a portion of the directional speaker and the regulator component that are in the audiovisual device shown in FIG. 3-1;

FIG. 3-6 is still another schematic structural view of the audiovisual device according to the embodiments of the present disclosure;

FIG. 3-7 is still another schematic structural view of the audiovisual device according to the embodiments of the present disclosure;

FIG. 3-8 is a structural block diagram of the audiovisual device according to the embodiments of the present disclosure;

FIG. 4 is a flowchart of a control method of the audiovisual device according to the embodiments of the present disclosure;

FIG. 5 is another flowchart of the control method of the audiovisual device according to the embodiments of the present disclosure; and FIG. 6 is a schematic structural view of the directional speaker in the audiovisual device according to the embodiments of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

For example, the audiovisual device includes a display screen and a speaker that is at an outer frame of the display screen. The display screen displays visual content, the speaker emits sound toward a display side of the display screen, so that a user on the display side of the display screen is able to hear the sound while watching the visual content.

The inventors of the present disclosure have found that the sound emitted by the speaker gradually spreads from the speaker and is distributed in a fan shape, so that the sound effects in different regions on the display side of the display screen are different, thus the user hears different sounds in different regions, and the sound effect of the audiovisual device is poor on the whole.

Figure 1:
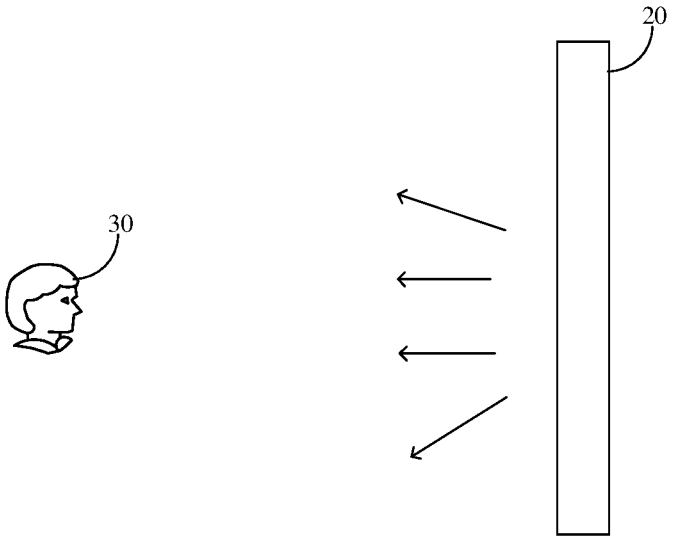
FIG. 1 is a schematic view of an implementation environment involved in embodiments of the present disclosure.

FIG. 1 is a schematic view of an implementation environment involved in embodiments of the present disclosure, and the implementation environment includes an audiovisual device 20 and a viewer 30, for example.

The audiovisual device 20 is, for example, an electronic picture frame, a picture frame with an audio component, or other video audio player device or the like. The audiovisual device 20 is configured for providing videos and audios to the viewer 30 according to a location of the viewer 30.

For the viewer 30, there is one viewer or a plurality of viewers, for example.

Figure 2:
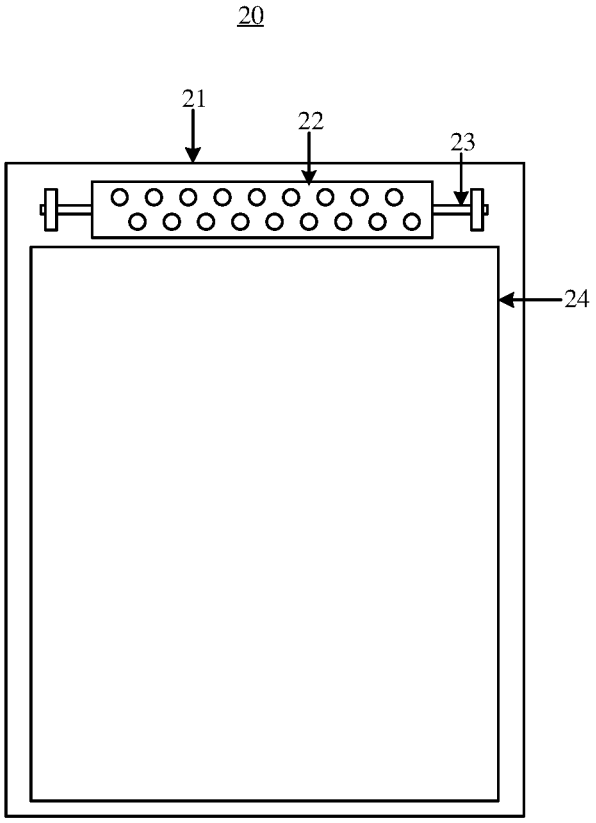
FIG. 2 is a schematic structural view of an audiovisual device according to the embodiments of the present disclosure.

FIG. 2 is a schematic structural view of the audiovisual device according to the embodiments of the present disclosure. The audiovisual device is, for example, the audiovisual device 20 in the implementation environment shown in FIG. 1, and the audiovisual device 20 includes:

a backboard 21, the backboard 21 being provided with a directional speaker 22, a regulator component 23, and a display component 24 that is configured for providing visual content, the directional speaker 22 being configured for emitting a sound toward a display side of the display component 24, and the regulator component 23 being configured for regulating an orientation of the directional speaker 22 on the display side of the visual assembly 24.

The audiovisual device provided by the embodiments of the present disclosure enables the viewer to hear a same sound at different positions by making the directional speaker emit the sound only toward the orientation of the directional speaker and making the directional speaker toward the viewer by the regulator component. In some technologies, the sound emitted by the speaker gradually spreads from the speaker and is distributed in the fan shape, which causes that the viewer hears different sounds in different regions and the sound effect of the audiovisual device is poor, such phenomenon is solved by the audiovisual device provided by the embodiments of the present disclosure and the effect of making the sound effect of the audiovisual device better is achieved.

Figures 1, 3:
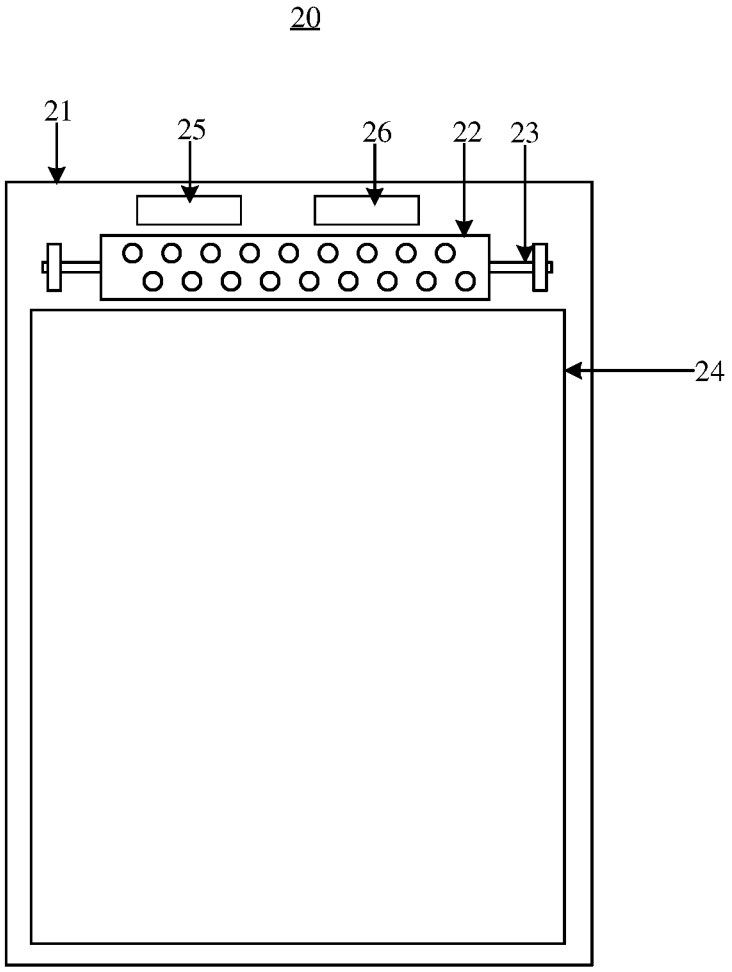
Figures 2, 3:
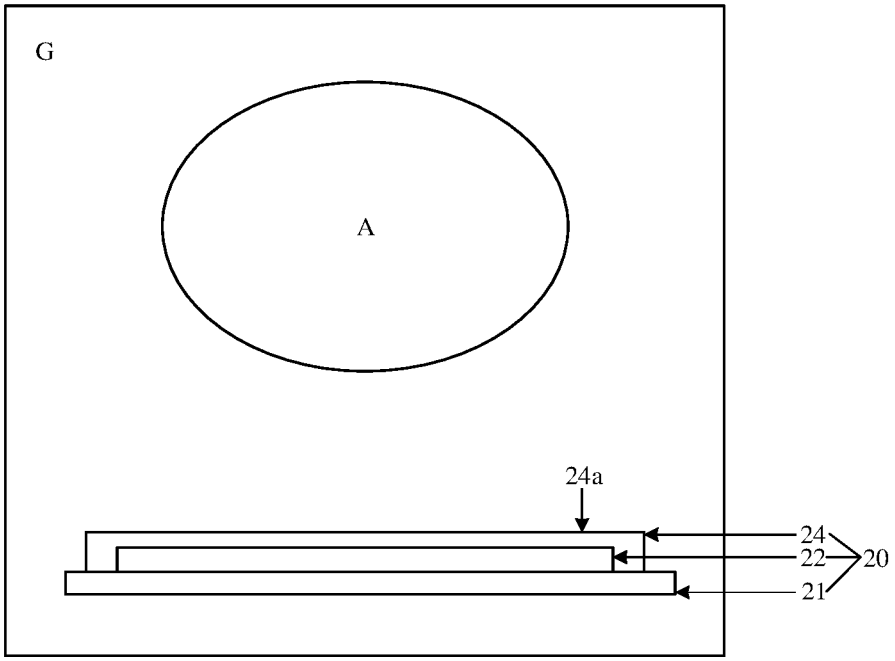
Figure 3:
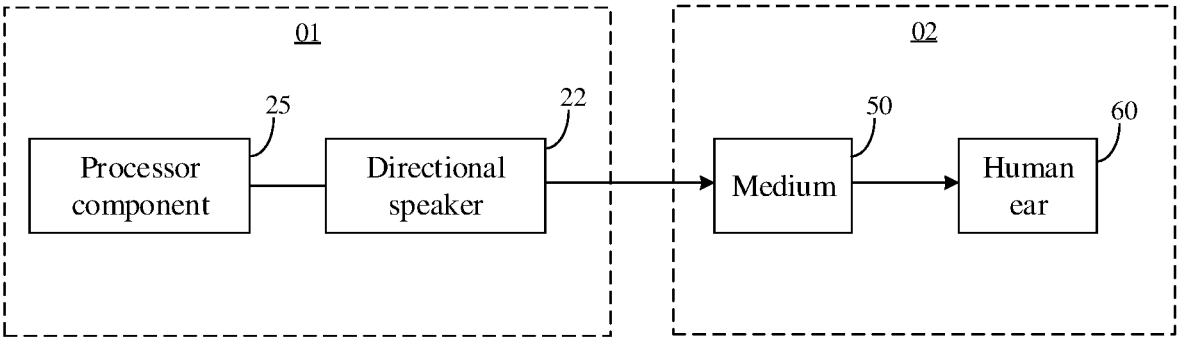

Referring to FIG. 3-1, another schematic structural view of the audiovisual device 20 provided by the embodiments of the present disclosure is shown.

For example, the directional speaker 22 is configured for emitting the sound to a preset service area, and the audiovisual device 20 further includes a processor component 25 and a sensor component 26. The processor component 25 and the sensor component 26 are both disposed at the backboard 21, for example.

The sensor component 26 is configured for determining whether a human body exists in the preset service area. In a situation where the sensor component 26 is in operation, an object that emits preset infrared light (the preset infrared light is, for example, infrared light with a wavelength of 3 micrometers to 50 micrometers normally radiated by the human body) in the preset service area is determined as the human body, or a moving object is determined as the human body, or an object that moves and has heat is determined as the human body, or the like. For example, the sensor component 26 includes an infrared sensor, a thermal sensor, a laser sensor or the like, the infrared sensor is configured for obtaining the preset infrared light, the thermal sensor is configured for determining whether the object that has heat is in the preset service area (the thermal sensor is, for example, also configured for determining a direction of the object that has heat), and the laser sensor is configured for determining whether the object that moves is in the preset service area (the laser sensor is, for example, also be configured for determining the direction of the object that moves).

The processor component 25 is configured for activating the directional speaker 22 in a situation where the human body exists in the predetermined service area. The processor component 25 is, for example, an integrated circuit (IC) or one or more central processing units (CPUs). The processor component 25 is, for example, further configured for controlling the display component 24. For example, the processor component 25 is able to run an Android system.

For example, the preset service area is an area that is preset and is, for example, located on the display side of the display component 24, and the display component 24 is viewed at a better viewing angle and distance in a situation where the viewer is located in the preset service area, and this prevents the person who does not view the display component 24 from hearing the sound emitted by the directional speaker 22 and prevents the generation of sound pollution. Exemplarily, as shown in FIG. 3-2 which is a schematic view of the audiovisual device 20 and the preset service area A in a situation where the backboard 21 of the audiovisual device 20 stands on the ground G (the backboard 21, for example, have a certain angle with the ground G), in the situation where the viewer is in the preset service area A, the display side 24*a* of the display component 24 is viewed, and the sound emitted by the directional speaker 22 is heard. The persons located outside the preset service area A are not in better viewing positions and thus are prone to not view the display side 24*a* of the display component 24, and the sound emitted by the directional speaker 22 is not heard by these persons located outside the preset service area A.

In FIG. 3-1, the sensor component 26 is further configured for obtaining the direction in which the human body is located in the situation where the human body exists in the preset service area. The sensor component 26 transmits information of the direction in which the human body is located to the processor component 25.

The regulator component 23 is configured for directing the directional speaker 22 toward the direction in which the human body is located. The processor component 25, for example, directs the directional speaker 22 toward the direction in which the human body is located through the regulator component 23. In this way, in the situation where viewers are in different positions in the preset service area, or in the situation where the same viewer moves in the preset service area, the directional speaker is always directed toward the direction in which the human body is located through the regulator component 23, thereby improving the sound effect of the sound heard by the viewers or by the viewer.

For example, the regulator component 23 is configured for directing the directional speaker 22 toward a head of the human body to reduce the energy loss of the sound.

Figures 3, 4:
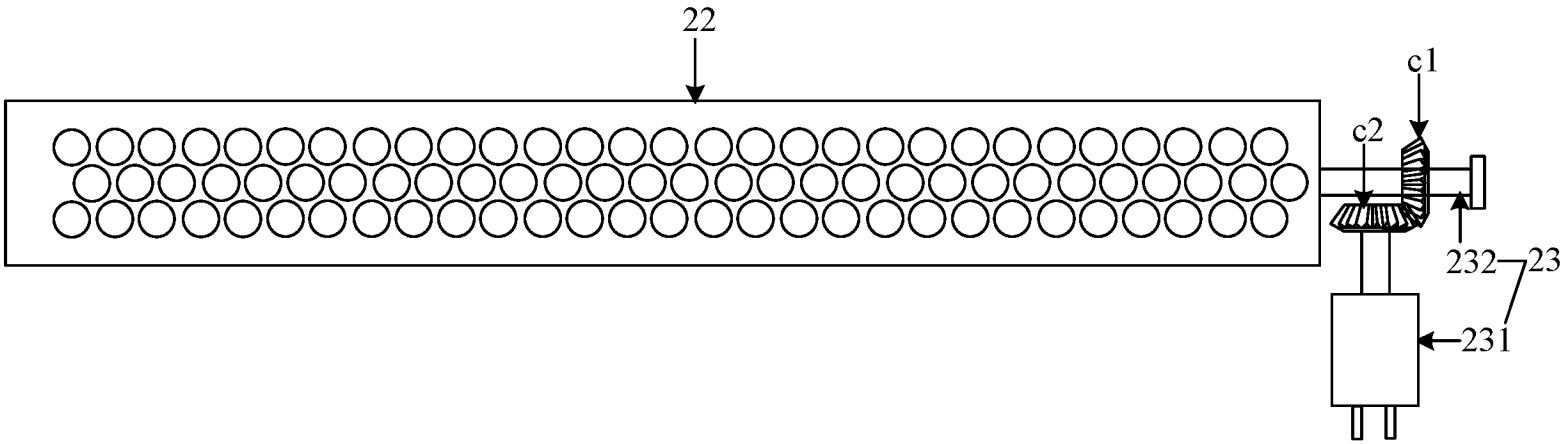
Figures 3, 4, 5:
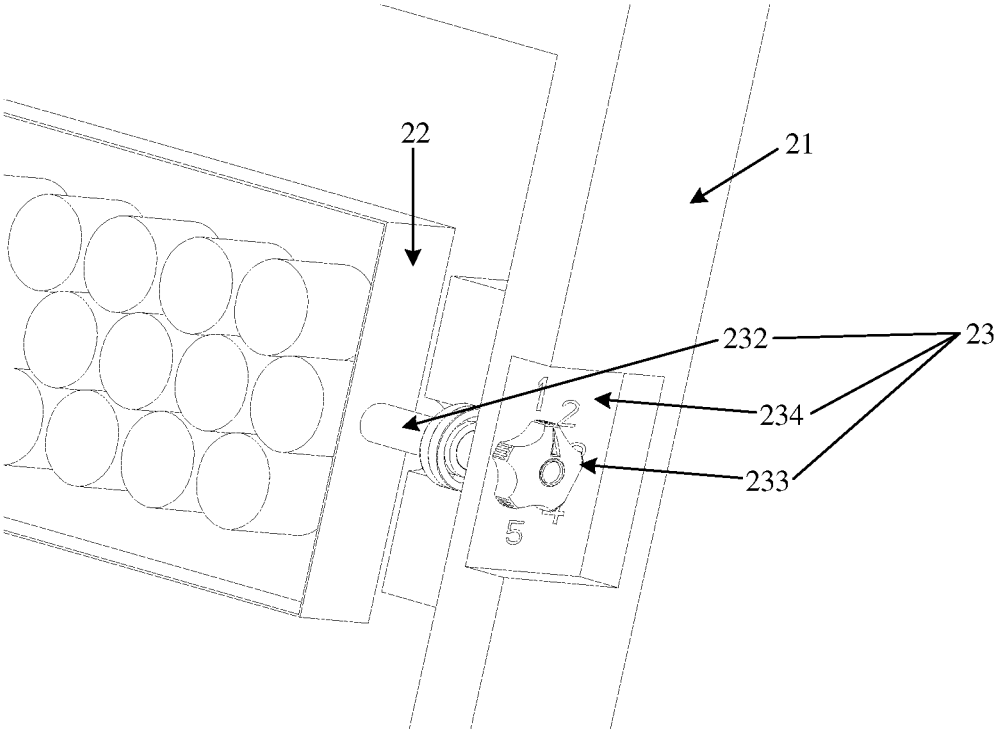
Figures 3, 4, 5, 6:
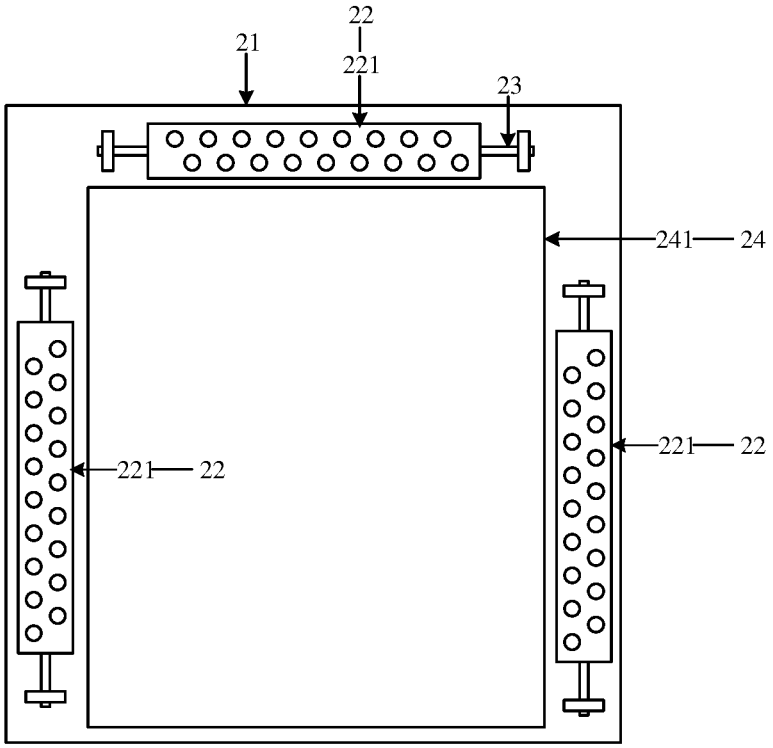
Figures 3, 4, 5, 6, 7:
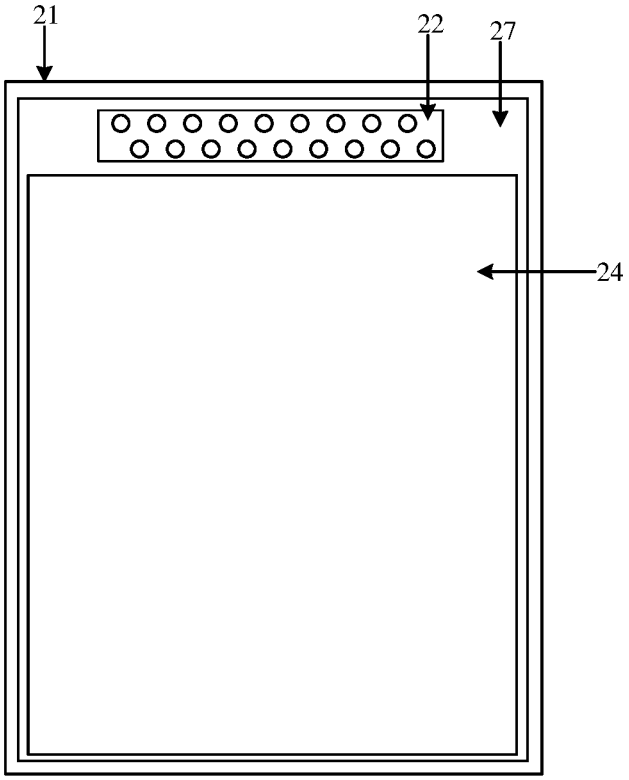
Figures 3, 4, 5, 6, 7, 8:
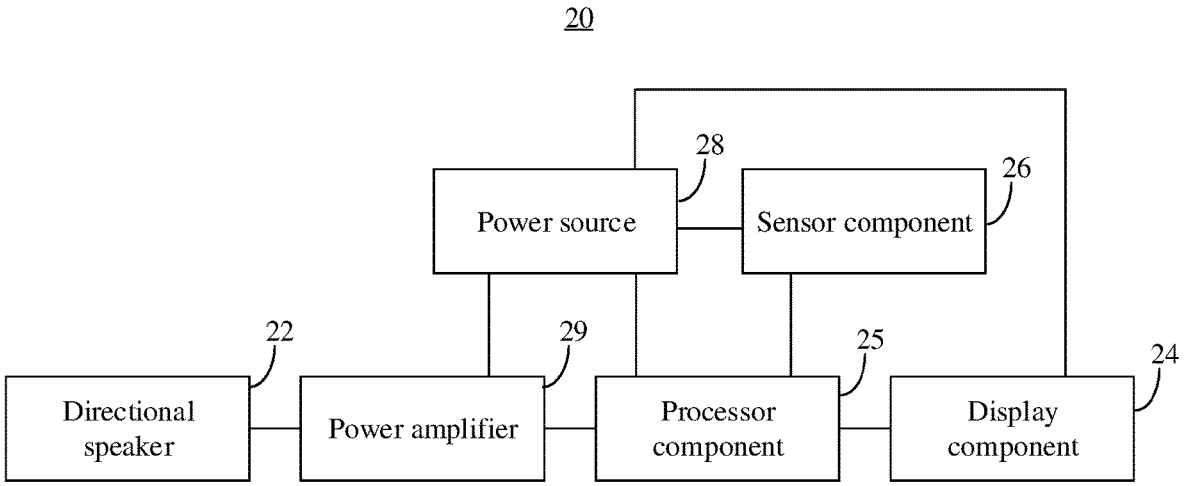
Figure 4:
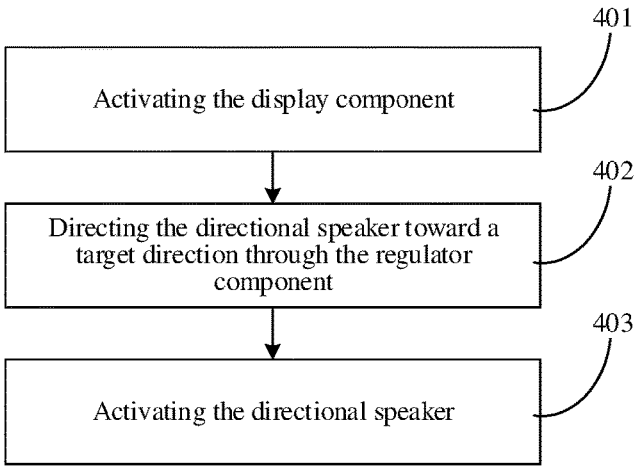
Figure 5:
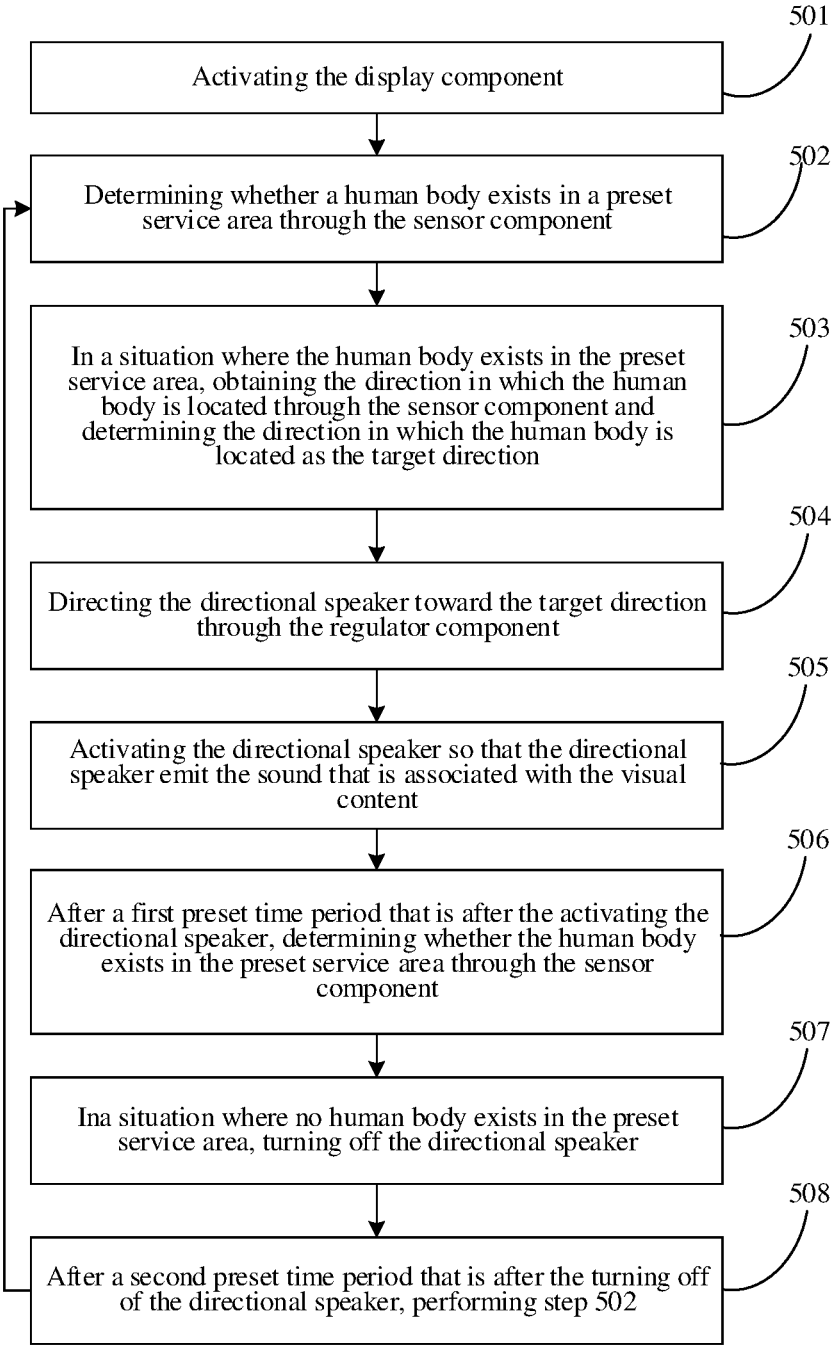
Figure 6:
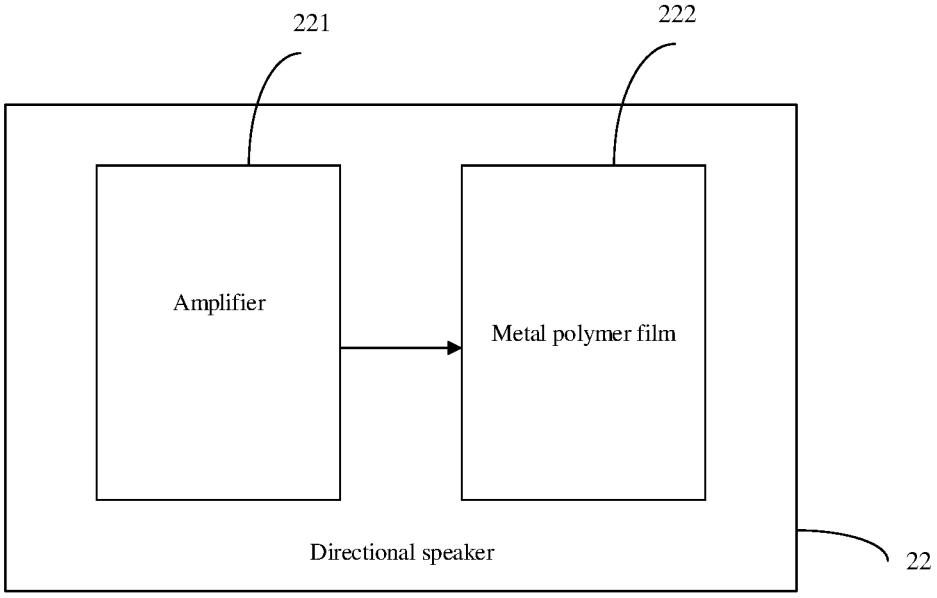

It should be noted that the directional speaker 22 is also called a directional sound generator and includes, for example, an amplifier 221 and a metal polymer film 222, as shown in FIG. 6. The amplifier 221 is configured for amplifying an audio signal input by the processor component 25 and then transmitting the audio signal to the metal polymer film 222, so that the metal polymer film 222 vibrates at 60,000 Hertz (Hz) or higher to generate an ultrasonic wave that has a short wavelength, strong directivity and an ability of propagating directionally. In a situation where the ultrasonic wave emitted by the directional speaker 22 propagates in the air and in the human body, a new frequency that is able to be heard by a human ear is generated.

For example, the directional speaker 22 includes a sound generator panel having a side that emits a directional sound wave.

As shown in FIG. 3-3, it is a schematic view of an acoustic system involving the directional speaker in the embodiments of the present disclosure and the human ear. The acoustic system, for example, includes a modulator portion 01 and a demodulator portion 02; the modulator portion 01, for example, includes the processor component 25 and the directional speaker 22; and the demodulator portion 02, for example, includes a medium (the medium including air and the human body) 50 and the human ear 60. In the modulator portion 01, the processor component 25 transmits an audio signal (in a situation where the audio signal is directly played, the frequency of an emitted sound based on the audio signal is a frequency that is able to be heard by the human ear) to the directional speaker 22, and the directional speaker emits the ultrasonic wave that acts as a modulation signal according to the audio signal and transmits the ultrasonic wave to the demodulator portion 02 directionally. The medium 50 in the demodulator portion 02 acts as a nonlinear channel system, the ultrasonic wave generates a sound wave that has a frequency of 20 Hz to 20 kHz after passing through the nonlinear channel system, and the sound wave that has the frequency of 20 Hz to 20 kHz is able to be heard by the human ear.

For example, as shown in FIG. 3-4, it is a schematic structural view of the directional speaker 22 and the regulator component 23 that are in the audiovisual device shown in FIG. 3-1.

The regulator component 23 includes, for example, a motor 231 and a rotation rod 232.

The directional speaker 22 is rotatably connected with the backboard (not shown in FIG. 3-3) via the rotation rod 232, and the rotation rod 232 is provided with a first gear c1. For example, the backboard is provided with two bearing seats, the directional speaker is securely connected with the rotation rod, and the rotation rod is rotatably connected with the backboard through the bearing seats.

A rotation shaft of the motor 231 is provided with a second gear c2, and the second gear c2 engages with the first gear c1. FIG. 3-3 shows the case where the first gear c1 and the second gear c2 are both bevel gears. For example, the first gear c1 and the second gear c2 are cylindrical gears, and the embodiments of the present disclosure are not limited thereto.

In addition, the regulator component in the embodiments of the present disclosure is, for example, manually regulable, as shown in FIG. 3-5 which is another schematic structural view of a portion of the directional speaker 22 and the regulator component 23 in the audiovisual device shown in FIG. 3-1. The regulator component 23 includes a regulation knob 233 and the rotation rod 232.

The directional speaker 22 is rotatably connected with the backboard 21 via the rotation rod 232, and the regulation knob 233 is connected with an end of the rotation rod 232.

For example, the regulator component 23 further includes a dial 234 that is connected with the backboard 21 and is configured for indicating a rotation angle of the regulation knob 233. The dial 234 shown in FIG. 3-5 represents the rotation angle by number; or the dial 234, for example, directly indicates the rotation angle, which is not limited in the embodiments of the present disclosure.

After the orientation of the directional speaker is regulated by the regulation knob 233, for example, the regulation knob 233 is covered by a preset housing to increase the beauty of the audiovisual device.

FIG. 3-6 is another schematic structural view of the audiovisual device according to the embodiments of the present disclosure. In FIG. 3-6, the display component 24 includes a rectangular display screen 241. The display screen 241 is, for example, a liquid crystal display (LCD) or an organic light-emitting diode (OLED) display. Additionally, the display component 24 includes a rectangular frame, for example.

The directional speaker 22 includes at least one strip sub-speaker 221, and a side of each sub-speaker is parallel to a side of the display screen 241. FIG. 3-6 shows a case where the number of sub-speakers 221 is three, but the number of the sub-speakers may also be 1, 2 or more, and the embodiments of the present disclosure does not limit.

The regulator component 23 is, for example, connected with each sub-speaker 221 to regulate the orientation of each sub-speaker 221. For example, one regulator component 23 is provided for each sub-speaker 221. In addition, for example, the orientations of the sub-speakers 221 are the same or different, and the embodiments of the present disclosure are not limited thereto.

For example, different sub-speakers 221 play sounds of different sound channels to further enhance the sound effect of the audiovisual device. Exemplarily, the two sub-speakers 221 respectively located on two sides of the display screen 241 in the horizontal direction in FIG. 3-1 respectively play the sound of a left sound channel and the sound of a right sound channel, and the sub-speaker located on a top side of the display screen 241 in the longitudinal direction is configured for playing the bass.

In addition, as shown in FIG. 3-7, it is still another schematic structural view of the audiovisual device according to the embodiments of the present disclosure. The audiovisual device further includes an outer frame 27, which is, for example, a wooden outer frame or a wood-like outer frame, and the outer frame 27 is coupled with both the directional speaker 22 and the display component 24, for example. For example, the visual assembly 24 is connected with the backboard 21 by, for example, a sheet metal member (not shown in FIG. 3-7). The backboard 21 is, for example, provided with a galvanized sheet (not shown in FIG. 3-7), and the processor component (not shown in FIG. 3-7) and various circuits are disposed at the galvanized sheet, for example. In addition, for example, the processor component is disposed in a housing body on a side, which is not provided with the visible component, of the backboard.

As shown in FIG. 3-8, it is a structural block diagram of the audiovisual device 20 according to the embodiments of the present disclosure. The audiovisual device 20 further includes, for example, a power source 28 and a power amplifier 29, the power source 28 is configured for providing electrical energy to the power amplifier 29, the processor component 25, the sensor component 26 and the display component 24, and the power amplifier 29 is configured for regulating the power of the directional speaker 22.

The audiovisual device provided by the embodiments of the present disclosure enables the viewer to hear the same sound at different positions by making the directional speaker emit the sound only toward the orientation of the directional speaker and regulating the directional speaker toward the viewer by the regulator component. In some technologies, the sound emitted by the speaker gradually spreads from the speaker and is distributed in the fan shape, which causes the sound effect in different regions on the display side of the display screen to be different, and thus causes that the viewer hears different sounds in the different regions, thereby leading to a poor sound effect of the audiovisual device; such phenomenon is solved by the audiovisual device provided by the embodiments of the present disclosure and the effect of making the sound effect of the audiovisual device better is achieved.

FIG. 4 is a flowchart of a control method of the audiovisual device according to the embodiments of the present disclosure, the method is used for controlling the audiovisual device described in any one of the foregoing embodiments, and the method includes:

Step 401: activating the display component.

Step 402: directing the directional speaker toward a target direction through the regulator component.

Step 403: activating the directional speaker.

The control method of the audiovisual device provided by the embodiments of the present disclosure enables the viewer to hear the same sound at different positions by making the directional speaker emit the sound only toward the orientation of the directional speaker and regulating the directional speaker toward the viewer by the regulator component. In some technologies, the sound emitted by the speaker gradually spreads from the speaker and is distributed in the fan shape, which causes the sound effect in different regions on the display side of the display screen to be different, and thus causes that the viewer hears different sounds in the different regions, thereby leading to the poor sound effect of the audiovisual device; such phenomenon is solved by the audiovisual device provided by the embodiments of the present disclosure and the effect of making the sound effect of the audiovisual device better is achieved.

FIG. 5 is another flowchart of the control method of the audiovisual device according to the embodiments of the present disclosure, the method is used for controlling the audiovisual devices described in any one of the foregoing embodiments, and the method includes:

Step 501: activating the display component.

For example, the display component is the display screen, the activating of the display component refers to activating the display screen so that the display screen displays a preset image. For example, in the situation where the display component is a physical frame, the activating of the display component refers to activating a lighting component that is configured for illuminating the physical frame.

Step 502: determining, through the sensor component, whether the human body exists in the preset service area.

For example, after the display component is activated, it is considered that the display component has begun to display the content; at this time, whether the human body exists in the preset service area is determined through the sensor component. For the sensor component and the preset service area, refer to the embodiments shown in FIG. 3-1, and details are not described herein.

Step 503: in the situation where the human body exists in the preset service area, the direction in which the human body is located is obtained through the sensor component, and the direction in which the human body is located is determined as the target direction.

For example, in the situation that the human body exists in the preset service area, it indicates that the viewer views the content shown by the display component; at this time, the direction in which the human body is located is obtained through the sensor component, and the direction in which the human body is located is determined as the target direction. For the description of the sensor component, refer to the embodiments shown in FIG. 3-1, and details are not described herein.

For example, the direction in which the head of the human body is located is determined as the target direction to reduce the energy loss of the sound and improve the sound effect.

For example, in the situation where no human body is in the preset service area, the sensor component is continuously used to determine whether the human body exists in the preset service area.

Step 504: directing the directional speaker toward the target direction through the regulator component.

For example, after the target direction is determined, the directional speaker is directed toward the target direction through the regulator component. For example, taking the structure shown in FIG. 3-4 as an example, the motor 231 is activated, so that the second gear c2 at the rotation shaft of the motor 231 rotates and drives the first gear c1 engaged with the second gear c2 to rotate, the first gear c1 drives the rotation shaft 232 to rotate, and the rotation shaft 232 drives the directional speaker 22 toward the target direction.

Step 505: activating the directional speaker so that the directional speaker emits the sound that is associated with the visual content displayed by the display component.

For example, after the directional speaker directs to the target direction, the directional speaker is activated so that the directional speaker emits the sound that is associated with the visual content displayed by the display component.

For example, in a situation where the visual content is a picture, the sound that is associated with the visual content is, for example, an introduction of an author, a drawing time and a content of the picture, or the like.

Step 506: after a first preset time period that is after the activating of the directional speaker, determining whether the human body exists in the preset service area by using the sensor component.

For example, after the first preset time period that is after the activating of the directional speaker, determining whether the human body exists in the preset service area through the sensor component avoids frequent opening and closing of the directional speaker, thereby achieving the effect of improving the life of the directional speaker. For example, the first preset time period is 5 seconds or more.

Alternatively, in the embodiments of the present disclosure, for example, as soon as the directional speaker is activated, it is determined whether the human body exists in the preset service area through the sensor component, which is not limited in the embodiments of the present disclosure.

Step 507: turning off the directional speaker in the situation where no human body exists in the preset service area.

In the situation where no human body exists in the preset service area, it indicates that no viewer views the visual content provided by the display component, and thus the directional speaker is, for example, turned off to save electricity energy.

Step 508: after a second preset time period that is after the directional speaker is turned off, the step 502 is performed.

After the second preset time period that is after the directional speaker is turned off, determining whether the human body exists in the preset service area through the sensor component avoids frequent opening and closing of the directional speaker, thereby achieving the effect of improving the life of the directional speaker. For example, the second preset time period is 5 seconds or more.

The control method of the audiovisual device provided by the embodiments of the present disclosure enables the viewer to hear the same sound at different positions by making the directional speaker emit the sound only toward the orientation of the directional speaker and regulating the directional speaker toward the viewer by the regulator component. In some technologies, the sound emitted by the speaker gradually spreads from the speaker and is distributed in the fan shape, which causes the sound effect in different regions on the display side of the display screen to be different, and thus causes that the viewer hears different sounds in the different regions, thereby leading to the poor sound effect of the audiovisual device; such phenomenon is solved by the audiovisual device provided by the embodiments of the present disclosure and the effect of making the sound effect of the audiovisual device better is achieved.

In the embodiments of the present disclosure, the terms "first" and "second" are used for descriptive purposes only, and are not to be construed as indicating or implying relative importance. The term "plurality" refers to two or more, unless specifically defined otherwise.

In the embodiments provided by the present disclosure, it should be understood that the disclosed device and method may be implemented in other manners. For example, the device embodiments described above are merely illustrative. For example, the division of the components is only a logical function division. In actual implementation, there may be another division manner, for example, multiple components may be combined or may be integrated into another system, or some features may be ignored or not executed. In addition, the mutual coupling or direct coupling or communication connection shown or discussed may be through some interfaces, an indirect coupling or communication connection of devices or components may be in an electrical or mechanical connection or other form connection.

A person skilled in the art can understand that all or part of the steps of implementing the above embodiments may be completed by hardware, or may be instructed by a program to execute related hardware, and the program may be stored in a computer readable storage medium. The storage medium mentioned may be a read only memory, a magnetic disk or an optical disk or the like.

What are described above are only exemplary embodiments of the present disclosure, and is not intended to limit the present disclosure. Any modifications, equivalents, improvements, etc., which are included in the spirit and principles of the present disclosure, should be included in the protection scope of the present disclosure.

What are described above is related to the illustrative embodiments of the disclosure only and not limitative to the scope of the disclosure; the scopes of the disclosure are defined by the accompanying claims.

What is claimed is:

1. An audiovisual device comprising:

a backboard;

a directional speaker, a regulator component, and a display component for providing visual content, wherein the directional speaker, the regulator component, and the display component are on the backboard;

the directional speaker is configured for emitting a directional sound to a display side of the display component, and the regulator component is configured for regulating an orientation of the directional speaker on the display side of the display component;

the regulator component comprises a regulation knob and a rotation rod;

the directional speaker is rotatably connected with the backboard through the rotation rod, and the regulation knob is connected with an end of the rotation rod; and the regulator component further comprises a dial that is connected with the backboard and is configured for indicating a rotation angle of the regulation knob.

2. The audiovisual device according to claim 1, wherein the directional speaker is configured for emitting the directional sound to a preset service area, the preset service area is on the display side of the display component;

the audiovisual device further comprises a processor component and a sensor component;

the sensor component is configured for determining whether a human body exists in the preset service area;

the processor component is configured for activating the directional speaker in a situation where the human body exists in the preset service area.

3. The audiovisual device according to claim 2, wherein the sensor component is further configured for obtaining a direction in which the human body is located in the situation where the human body exists in the preset service area;

the regulator component is configured for directing the directional speaker toward the direction in which the human body is located.

4. The audiovisual device according to claim 3, wherein the regulator component is configured for directing the directional speaker toward a head of the human body.

5. The audiovisual device according to claim 1, wherein the regulator component comprises a motor, a rotation rod, a first gear and a second gear;

the directional speaker is rotatably connected with the backboard through the rotation rod, and the rotation rod is provided with the first gear;

a rotation shaft of the motor is provided with the second gear, and the second gear engages with the first gear.

6. The audiovisual device according to claim 1, wherein the display component comprises a rectangular display screen;

the directional speaker comprises at least one strip sub-speaker, and a side of the sub-speaker and a side of the display screen are parallel to each other.

7. The audiovisual device according to claim 1, wherein the directional speaker comprises an amplifier and a metal polymer film, and the amplifier is configured for amplifying an audio signal input by the processor component and then transmitting the audio signal to the metal polymer film, so that the metal polymer film vibrates to generate an ultrasonic wave.

8. A control method of an audiovisual device, wherein the audiovisual device comprises a backboard which is provided with a directional speaker, a regulator component and a display component that is configured for providing visual content, the directional speaker is configured for emitting a directional sound to a display side of the display component, and the regulator component is configured for regulating an orientation of the directional speaker on the display side of the display component;

the method comprises:

activating the display component, directing the directional speaker toward a target direction through the regulator component, and activating the directional speaker;

the directional speaker is configured for emitting the directional sound to a preset service area, the preset service area is on the display side of the display component;

the audiovisual device further comprises a processor component and a sensor component;

before the directing the directional speaker toward the target direction through the regulator component, the method further comprises: determining whether a human body exists in the preset service area through the sensor component; and after the activating the directional speaker, the method further comprises: determining, through the sensor component, whether the human body exists in the preset service area after a first preset time period that is after the activating the directional speaker; turning off the directional speaker in a situation where no human body exists in the preset service area.

9. The method according to claim 8, wherein before the directing the directional speaker toward the target direction through the regulator component, the method further comprises:

in a situation where the human body exists in the preset service area, obtaining a direction in which the human body is located through the sensor component, and determining the direction in which the human body is located as the target direction.

10. The method according to claim 9, wherein the directing the directional speaker toward the target direction through the regulator component, comprises: directing the directional speaker toward a head of the human body through the regulator component.

11. The method according to claim 8, wherein after turning off the directional speaker, the method further comprises:

after a second preset time period that is after the turning off of the directional speaker, determining whether the human body exists in the preset service area through the sensor component.

12. The method according to claim 8, wherein the activating the directional speaker comprises:

activating the directional speaker so that the directional speaker emits the directional sound that is associated with the visual content.

* * * * *